US009970443B2

(12) United States Patent
Chang et al.

(10) Patent No.: US 9,970,443 B2
(45) Date of Patent: May 15, 2018

(54) FAN FRAME AND FAN ASSEMBLY WITH SILENCING STRUCTURES

(71) Applicant: DELTA ELECTRONICS, INC., Taoyuan (TW)

(72) Inventors: Shun-Chen Chang, Taoyuan (TW); Chao-Fu Yang, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 289 days.

(21) Appl. No.: 14/672,760

(22) Filed: Mar. 30, 2015

(65) Prior Publication Data

US 2016/0017895 A1 Jan. 21, 2016

(30) Foreign Application Priority Data

Jul. 18, 2014 (CN) ..... 2014 1 0344412

(51) Int. Cl.

| | |
|---|---|
| ***F04D 19/00*** | (2006.01) |
| ***F04D 25/06*** | (2006.01) |
| ***F04D 29/66*** | (2006.01) |
| ***F04D 29/52*** | (2006.01) |

(52) U.S. Cl.

CPC ..... *F04D 19/002* (2013.01); *F04D 25/0613* (2013.01); *F04D 29/522* (2013.01); *F04D 29/663* (2013.01); *F04D 29/665* (2013.01)

(58) Field of Classification Search

CPC ..... F04D 19/00; F04D 19/002; F04D 29/663; F04D 29/665; F04D 25/0613; F04D 29/522; F04D 29/66

See application file for complete search history.

(56) References Cited

U.S. PATENT DOCUMENTS

| | | | | |
|---|---|---|---|---|
| 6,309,176 | B1 * | 10/2001 | Periyathamby | F01P 11/12 415/119 |
| 6,896,095 | B2 * | 5/2005 | Shah | F01P 5/06 181/198 |
| 6,983,920 | B2 * | 1/2006 | DeLine | B60R 1/04 248/481 |
| 9,441,642 | B2 * | 9/2016 | Rao | F04D 29/162 |
| 2002/0076323 | A1 * | 6/2002 | Fujinaka | F04D 29/547 415/220 |
| 2007/0292261 | A1 * | 12/2007 | Tang | F04D 25/08 415/119 |
| 2008/0247864 | A1 * | 10/2008 | Chang | F04D 25/0613 415/119 |
| 2012/0269665 | A1 * | 10/2012 | Takeshita | F04D 25/0606 417/420 |

(Continued)

FOREIGN PATENT DOCUMENTS

CN 103557184 A 2/2014

*Primary Examiner* — Woody Lee, Jr.
*Assistant Examiner* — Elton Wong
(74) *Attorney, Agent, or Firm* — Muncy, Geissler, Olds & Lowe, P.C.

(57) ABSTRACT

A fan assembly and a fan frame thereof are disclosed. The fan assembly includes a fan frame and an impeller disposed in the fan frame. The fan frame has an air inlet end and an air outlet end, and includes a sidewall, a top portion and a bottom portion. The top portion is disposed close to the air inlet end and connected to one end of the sidewall. The bottom portion is disposed close to the air outlet end and connected to the other end of the sidewall. The bottom portion has at least one silencing structure.

18 Claims, 11 Drawing Sheets

(56) References Cited

U.S. PATENT DOCUMENTS

| | | | | |
|---|---|---|---|---|
| 2013/0287605 | A1* | 10/2013 | Kimura | F04D 25/0613<br>417/410.1 |
| 2014/0010636 | A1* | 1/2014 | Hsieh | F04D 29/66<br>415/119 |
| 2014/0227081 | A1* | 8/2014 | Wang | F04D 29/664<br>415/119 |

* cited by examiner

FAN FRAME AND FAN ASSEMBLY WITH SILENCING STRUCTURES

CROSS REFERENCE TO RELATED APPLICATIONS

This Non-provisional application claims priority under 35 U.S.C. § 119(a) on Patent Application No(s). 201410344412.7 filed in People's Republic of China on Jul. 18, 2014, the entire contents of which are hereby incorporated by reference.

BACKGROUND OF THE INVENTION

Field of Invention

The present invention relates to a fan assembly and, in particular, to a fan frame of the fan assembly.

Related Art

In general, the fan usually generates some noises during operation. Therefore, it is desired to solve the noise issue of a fan during operation. The reason of generating the noise may include the airflow turbulence around the air inlet and air outlet or the vibration of the fan body. The noise caused by the vibration of the fan body can be minimized by designing a buffer structure or enhancing the connection intensity between the components of the fan.

However, the noise caused by the turbulence flow around the air inlet and air outlet becomes more obvious relatively, and this noise cannot be decreased by the additional buffer structure or enhanced connection intensity. In order to solve the noise issue, it is necessary to add some additional components or modify the shape of the fan frame to change the flow field. Unfortunately, these solutions can also sufficiently reduce the performance and property of the fan.

SUMMARY OF THE INVENTION

In view of the foregoing, an objective of the present invention is to provide a fan assembly and a fan frame that have a novel and simple structure design for remaining the performance of the fan assembly and simultaneously improving the noise issue caused by flow field.

To achieve the above objective, the present invention discloses a fan frame having an air inlet end and an air outlet end. The fan frame includes a sidewall, a top portion and a bottom portion. The top portion is disposed close to the air inlet end and connected to one end of the sidewall. The bottom portion is disposed close to the air outlet end and connected to the other end of the sidewall. The bottom portion has at least one silencing structure.

To achieve the above objective, the present invention also discloses a fan assembly including a fan frame and an impeller. The fan frame has an air inlet end and an air outlet end, and includes a sidewall, a top portion and a bottom portion. The top portion is disposed close to the air inlet end and connected to one end of the sidewall. The bottom portion is disposed close to the air outlet end and connected to the other end of the sidewall. The bottom portion has at least one silencing structure. The impeller is disposed in the fan frame.

In one embodiment, the silencing structure includes a recess, a blind hole or a groove.

In one embodiment, the bottom portion has two silencing structures, and the two silencing structures are separated by a distance and aligned to each other.

In one embodiment, the bottom portion has a plurality of the silencing structures, and the silencing structures are arranged discontinuously and symmetrically.

In one embodiment, the shape of the silencing structure is a long strip, square, circle or any other geometric shape.

In one embodiment, the sidewall includes an inner sidewall and an outer sidewall disposed opposite to the inner sidewall. The top portion connects the inner sidewall to the outer sidewall, and the bottom portion connects the inner sidewall to the outer sidewall. The inner sidewall, the outer sidewall, the top portion and the bottom portion form a chamber.

In one embodiment, the silencing structure is a through hole connecting the chamber to outside.

In one embodiment, the fan frame further includes a first frame member and a second frame member. The inner sidewall, the top portion and a part of the outer sidewall form the first frame member, and the bottom portion and a part of the outer sidewall form the second frame member.

In one embodiment, the top portion has at least one drainage hole.

In one embodiment, the silencing structure is capable of absorbing a noise with a wavelength greater than 4 times of a height of the chamber.

As mentioned above, the fan frame of the invention is configured with a silencing structure, and the silencing structure is positioned at the bottom portion (the air outlet end) while the bottom portion has a non-planar shape. When the airflow generated by the fan flows through the bottom portion, it is possible to generate a small vortex at the bottom portion due to the design of the silencing structure, thereby reducing the turbulence flow at the air outlet end. As a result, the noise caused by the turbulence flow can be sufficiently decreased. More important, the configuration of the silencing structure can achieve the purpose of decreasing noise without affecting the original static pressure-air quantity property of the fan assembly.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
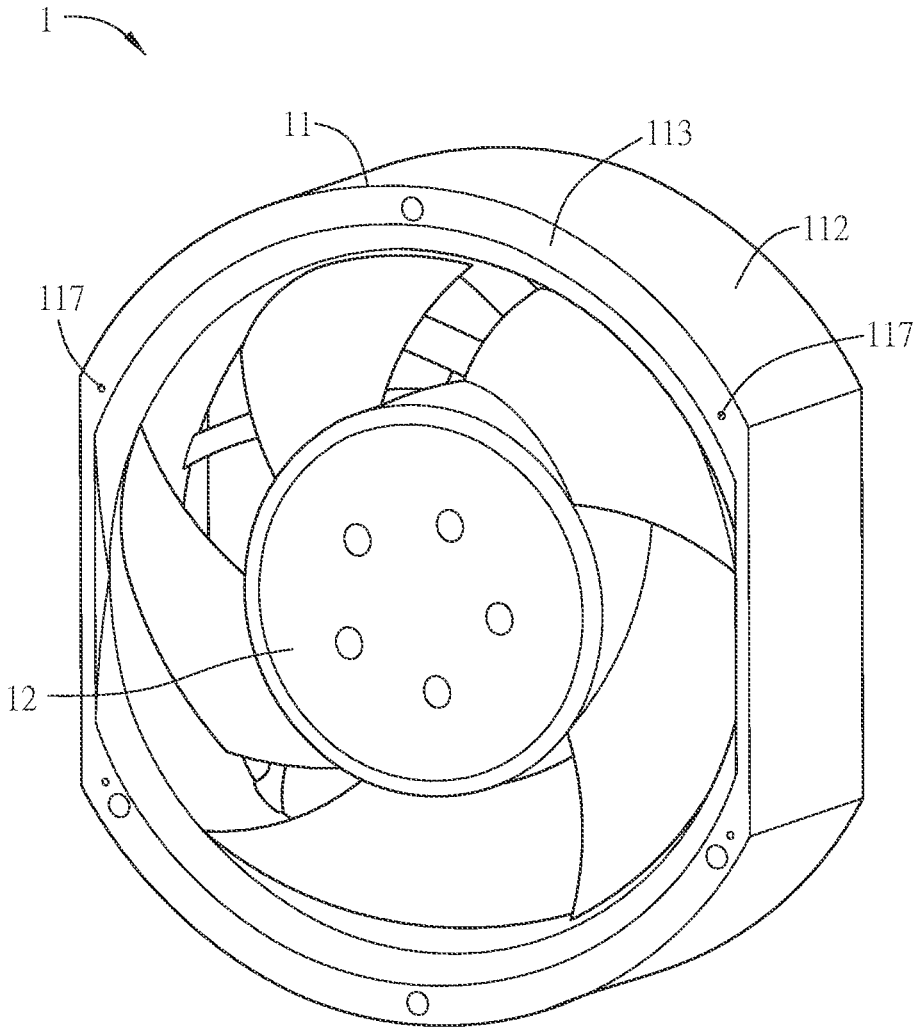
FIG. 1 is a schematic diagram showing a fan assembly according to a first embodiment of the invention.
Figure 2:
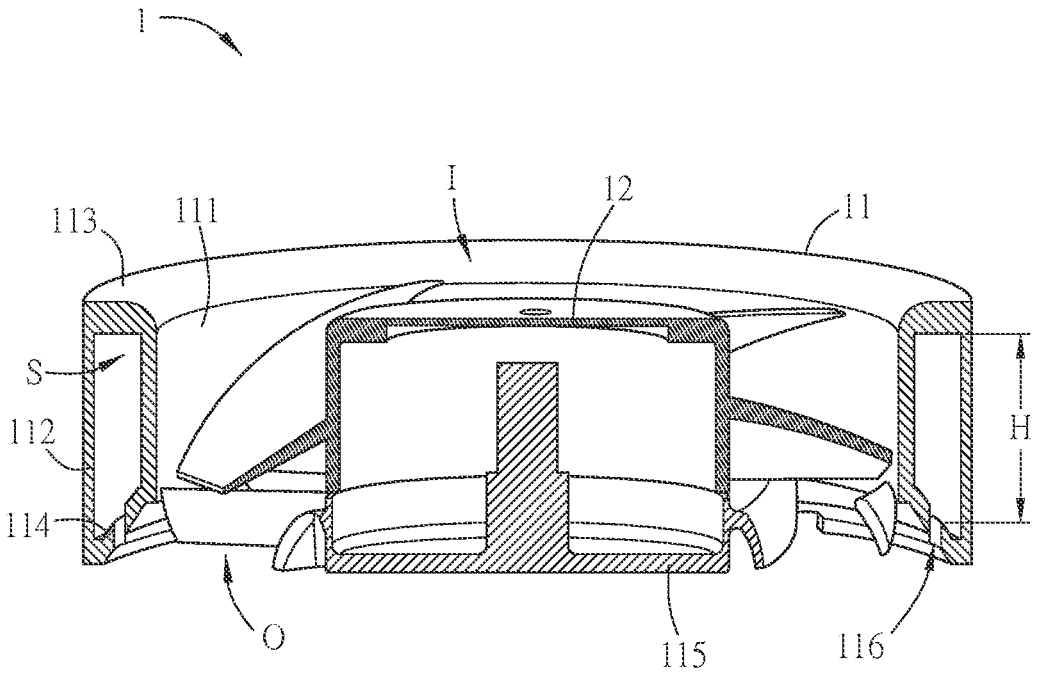
FIG. 2 is a sectional view of the fan assembly of FIG. 1.

FIG. 1 is a schematic diagram showing a fan assembly according to a first embodiment of the invention, and FIG. 2 is a sectional view of the fan assembly of FIG. 1. Referring to FIGS. 1 and 2, the fan assembly 1 includes a fan frame 11 and an impeller 12. When the fan assembly 1 is operating, an air inlet end I is formed at one side of the fan frame 11 while an air outlet end O is formed at the other side of the fan frame 11. In other words, the fan frame 11 has an air inlet end I and an air outlet end O. The fan assembly 1 can be driven by a motor so as to rotate the impeller. This is well known to the skilled persons in the art, so the detailed description thereof will be omitted. In this embodiment, the fan frame 11 includes a sidewall such as an inner sidewall 11 and an outer sidewall 112. Besides, the fan frame 11 further includes a top portion 113 and a bottom portion 114. The inner sidewall 111 and the outer sidewall 112 are disposed opposite to each other. The top portion 113 and the bottom portion 114 connect to the inner sidewall 111 and the outer sidewall 112, so that a chamber S is formed between the inner sidewall 111, the outer sidewall 112, the top portion 113 and the bottom portion 114. The top portion 113 is positioned close to the air inlet end I, and the bottom portion 114 is positioned close to the air outlet end O.

In addition, the relative positions of the inner sidewall 111 and the outer sidewall 112 are not limited in this invention. In more detailed, the inner sidewall 111 and the outer sidewall 112 can be arranged in parallel or not as long as they can form the chamber S with the top portion 113 and the bottom portion 114. Accordingly, the inner sidewall 111, the outer sidewall 112, the top portion 113 and the bottom portion 114 can together form the outer frame of the fan frame 11. In this embodiment, the fan frame 11 further includes a bearing house 115, and the impeller 12 is installed on the bearing house 115 and thus disposed in the fan frame 11. The impeller 12 and the bearing house 115 form a space for accommodating a motor, which is configured to drive the impeller 12 to rotate.

Figure 3:
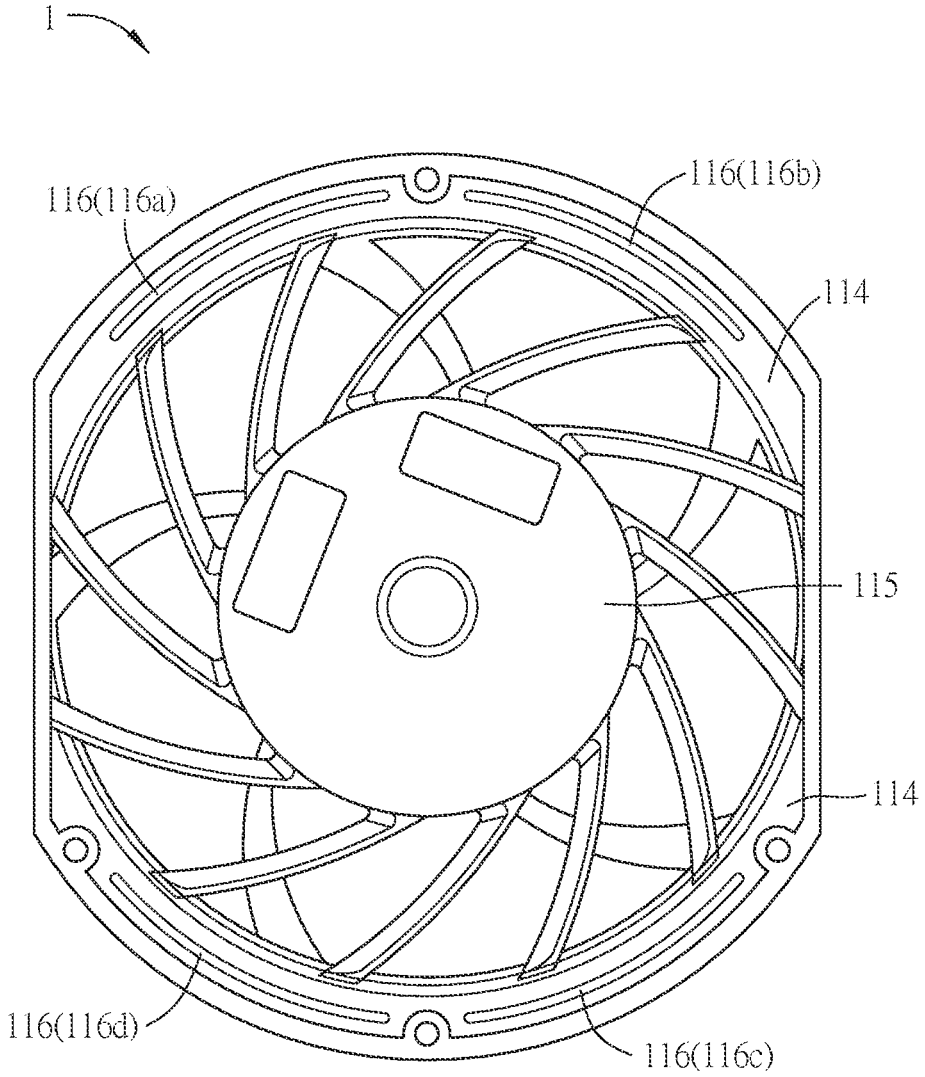
FIG. 3 is a bottom view of the fan assembly of FIG. 1.

FIG. 3 is a bottom view of the fan assembly 1 of FIG. 1 viewing from the bottom portion 114 of the fan assembly 1. With reference to FIGS. 2 and 3, the bottom portion 114 disposed close to the air outlet end O has at least one silencing structure 116. In this embodiment, the silencing structure 116 is a through hole, so that the chamber S can communicate with the outside through the silencing structure 116. In other words, the chamber S is not an isolated space. In this embodiment, four silencing structures 116 are disposed adjacent to each other. Of course, in other embodiments, it is possible to configure an annular silencing structure disposed around the bottom portion of the fan frame. This invention is not limited thereto.

Figure 4:
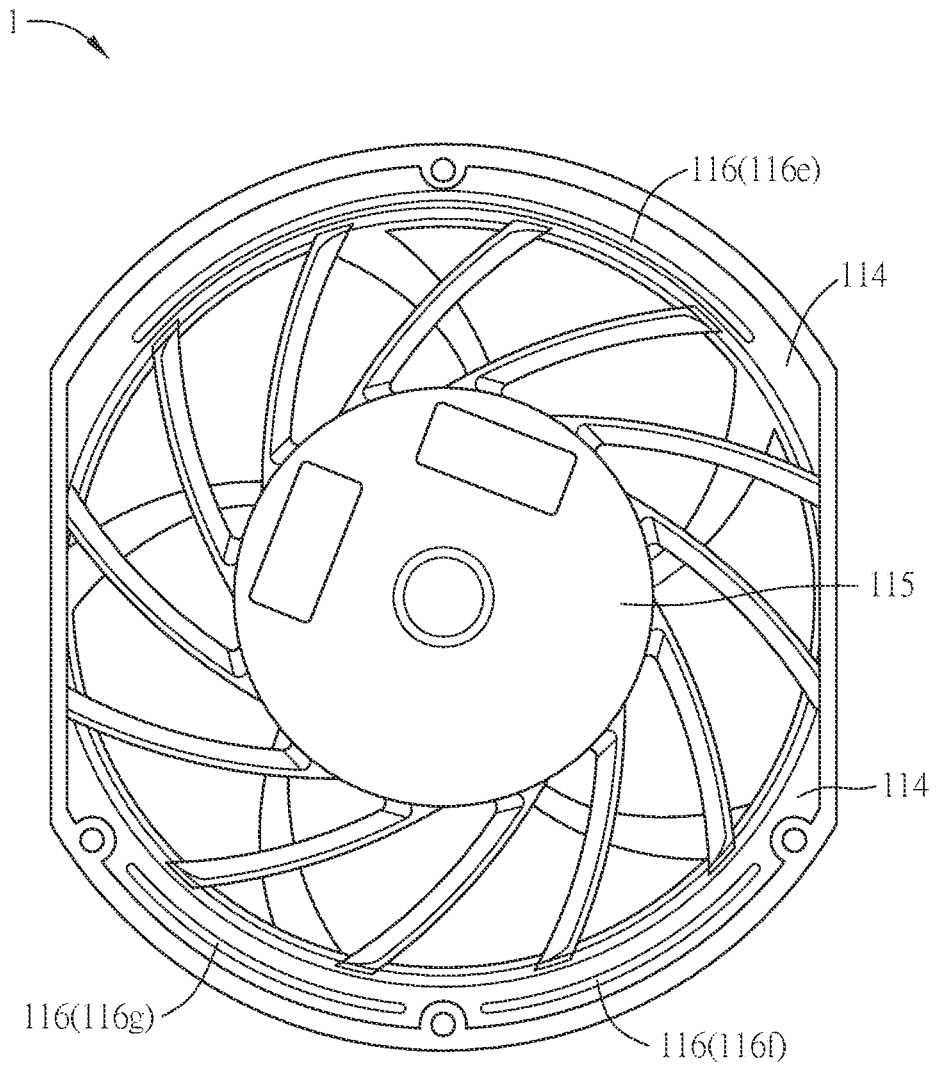
FIG. 4 is a bottom view showing another aspect of the fan assembly according to the first embodiment of the invention.

Preferably, the four non-continuous silencing structures 116 are arranged symmetrically. In this embodiment, two silencing structures 116 located at one side of the bottom portion 114 are opposite to and symmetric to the other two silencing structures 116 located at the opposite side of the bottom portion 114. As shown in FIG. 3, the silencing structure 116*a* is symmetric to the silencing structure 116*c*, while the silencing structure 116*b* is symmetric to the silencing structure 116*d*. Referring to FIG. 4, one side of the bottom portion 114 has a single silencing structure 116*e*, and the other side thereof has two silencing structures 116*f* and 116*g* disposed corresponding to the silencing structure 116*e*. Of course, the number of the silencing structures in each side can be changed, and this invention is not limited. In some embodiment, the fan frame 11 can have a circular shape, and an odd number of silencing structures 116 can be configured, and the interval between adjacent silencing structures 116 is identical.

Figure 5:
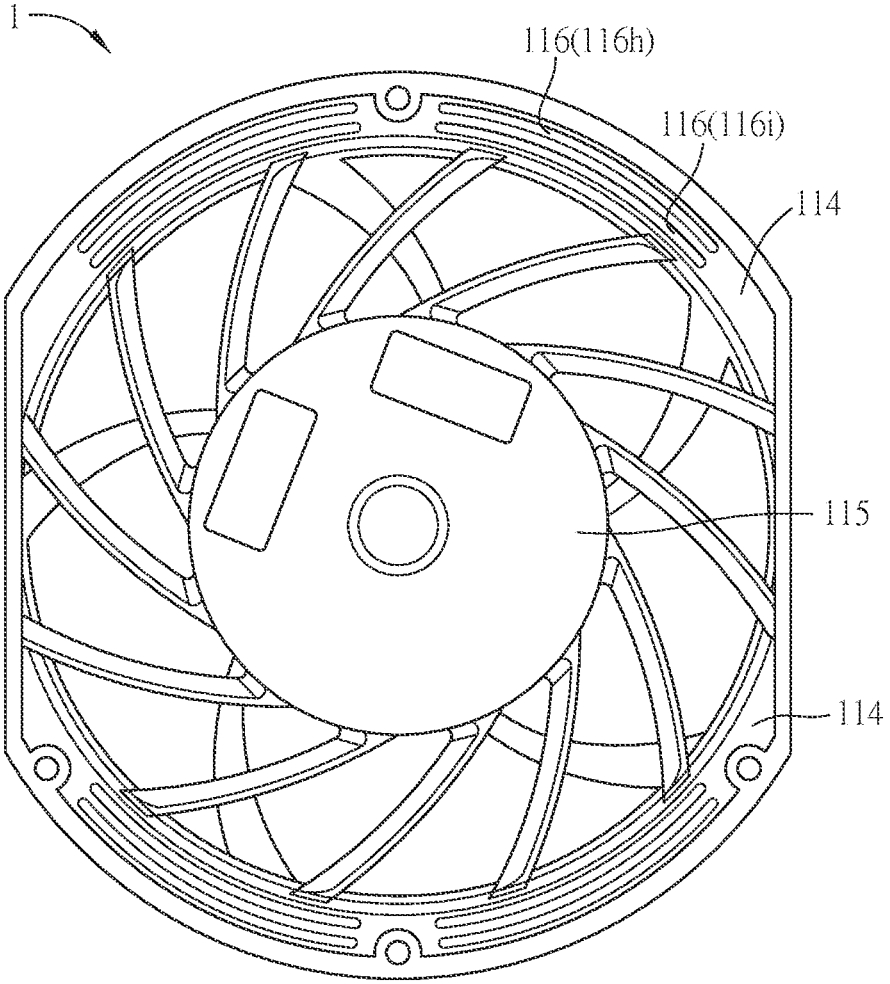
FIG. 5 is a bottom view showing another aspect of the fan assembly according to the first embodiment of the invention.

FIG. 5 is a bottom view showing another aspect of the fan assembly according to the first embodiment of the invention. In this embodiment, the bottom portion 114 has two or more silencing structures 116, and the silencing structures 116 are disposed opposite to each other and aligned, which can be called as a dual-hole silencing structure with a chamber. As shown in FIG. 5, the silencing structure 116*h* and the silencing structure 116*i* are separated by a distance and disposed opposite to each other. Preferably, the silencing structure 116*h* and the silencing structure 116*i* are disposed in parallel and aligned to each other. This invention does not limit the amount and arrangement of the silencing structures 116.

Preferably, the silencing structure 116 has a long strip shape. Of course, it is possible to arrange a plurality of silencing structures 116 (in square, circular or other geometric shapes) in a row so that they can together form a long strip shape. This invention is not limited.

When the fan assembly 1 operates in a back pressure situation, the turbulence flow at the air outlet end O becomes more obvious so as to generate undesired noise. The fan frame 11 of this embodiment has the silencing structure(s) 116 configured at the bottom portion 114. This design can induce a vortex at the silencing structure 116 as the air flows through the bottom portion 114 (the air outlet end O). In other words, the vortex generated at the silencing structure 116 can minimize the turbulence flow at the air outlet end O, thereby reducing the noise caused by the turbulence flow.

Moreover, the silencing structure 116 is a through hole, so that the non-enclosed chamber S can provide a space, which functions as the pores of a porous sound-absorbing material (sound-absorbing space), for absorbing the noise. Referring to FIG. 2, the height H of the chamber S is related to the wavelength of the absorbed sound (including the noise). The silencing structure 116 works based on the quarter-wavelength tube principle. In other words, the length of the tube (the height H of the chamber S) is ¼ of the fundamental resonance wavelength. For example, if the height H of the chamber S is 10 mm, the fundamental resonance wavelength ($\lambda$) is $n \times 40$ mm, wherein n is a positive integer (e.g. 1, 2, 3 . . . ). In general, the unit of the wavelength is meter (m), and the wavelength ($\lambda$) is inversely related to the frequency ($\nu$). Herein, the frequency represents the number of waves passing through a specific point within a fixed period. The function of the silencing structure 116 and the chamber S is to generate resonance with the noise caused by a specific frequency, which is corresponding to a specific wavelength being 4 times of the height H of the chamber S, thereby achieving the goal of reducing the noise. In brief, the fan frame 11 of this embodiment has the silencing structure(s) 116 and the chamber S for absorbing the noise with the wavelength of 4n times of the height H. Besides, the chamber S and the silencing structures 116 (through holes) can further provide a dust collection function.

Referring to FIG. 1, the top portion 113 further has a drainage hole 117 which is connected to the chamber S. When the fan assembly 1 is reversed, which means that the top portion 113 is placed down while the bottom portion 114 is place up, and disposed at outdoor or a wet environment, the rain or water can enter the chamber S through the silencing structure 116 so as to damage the fan assembly 1. The configuration of the drainage hole 117 on the top portion 113 allows the liquid entering the chamber S through the silencing structure 116 to be discharged.

Figure 6:
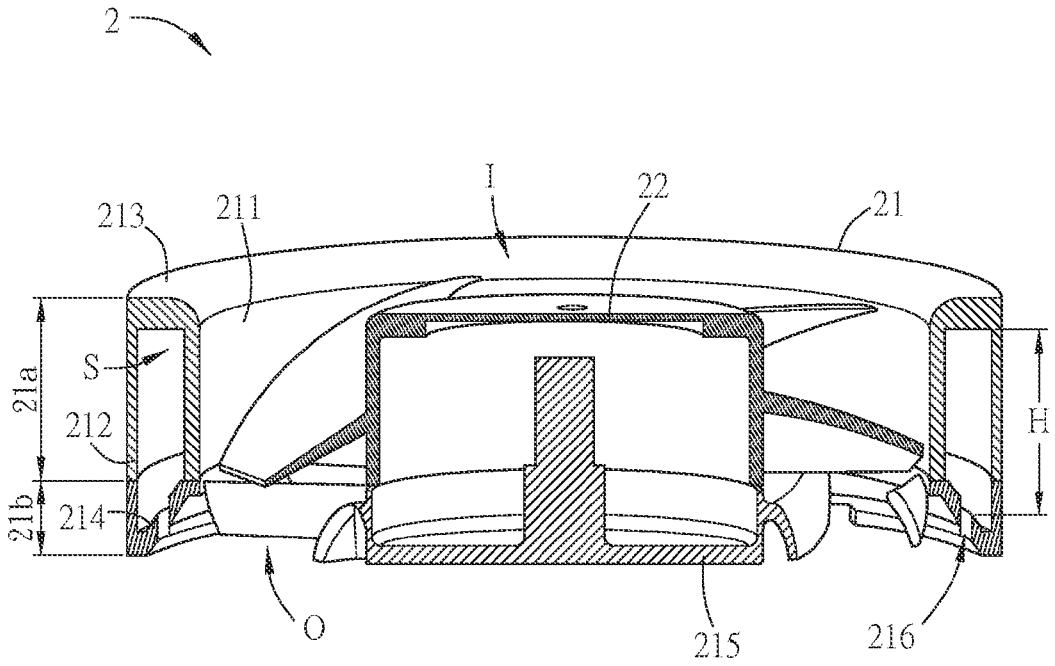
FIG. 6 is a sectional view of a fan assembly according to a second embodiment of the invention.

In other embodiments, the fan frame can be composed by two members. FIG. 6 is a sectional view of a fan assembly according to a second embodiment of the invention. As shown in FIG. 6, the fan assembly 2 is composed of a fan frame 21 and an impeller 22, wherein the fan frame 21 includes a bearing house 215 and two members. In more specific, a first frame member 21*a* provides the inner sidewall 211, the top portion 213 and a part of the outer sidewall 212, and a second frame member 21*b* provides the bottom portion 214 and a part of the outer sidewall 212. The bottom portion 214 has a slant structure and the inner sidewall 211 is shorter than the outer sidewall 212. The fan frame 21 in this embodiment also has a silencing structure 216 configured at the bottom portion 214. The first frame member 21*a* and the second frame member 21*b* can be fabricated by two molds. One mold has a structure corresponding to the inner sidewall 211, the top portion 213 and a part of the outer sidewall 212 for forming the first frame member 21*a*, while the other mold has a structure corresponding to the bottom portion 214 and a part of the outer sidewall 212 for forming the second frame member 21*b*. The first frame member 21 and the second frame member 21*b* can be combined by adhering or screwing so as to form the fan frame 21. The structures and features of other components of the fan assembly 2 can be referred to the fan assembly 1, so the detailed descriptions thereof will be omitted.

Figure 7:
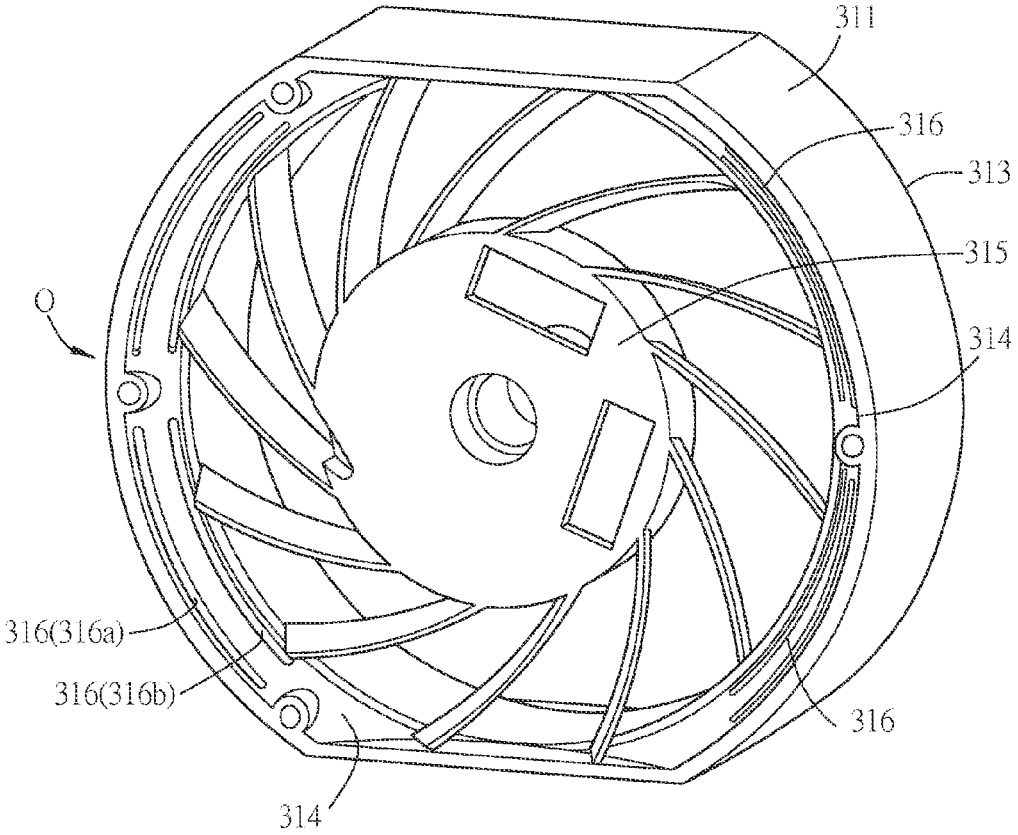
FIG. 7 is a schematic diagram showing a fan frame according to a third embodiment of the invention.

FIG. 7 is a schematic diagram showing a fan frame according to a third embodiment of the invention. Referring to FIG. 7, the fan frame 31 includes a sidewall 311, a top portion 313 and a bottom portion 314. The fan frame 31 is combined with an impeller, which is disposed in the fan frame 31, so as to form a fan assembly. Similarly, when the fan assembly operates, one end of the fan frame 31 forms an air inlet end I while the other end of the fan frame 31 forms an air outlet end O. The top portion 313 is connected to one end (the air inlet end I) of the sidewall 311, and the bottom portion 314 is connected to the other end (the air outlet end O) of the sidewall 311. In this embodiment, the fan frame 31 also includes a bearing house 315 for accommodating the impeller. The bottom portion 314 has at least one silencing structure 316. In this embodiment, the silencing structure 316 is a recess. Similarly, the number, configuration and shape of the silencing structure 316 are not limited in this embodiment. Preferably, the bottom portion 314 has a plurality of non-continuous silencing structures 316, which are symmetrically arranged. The symmetric arrangement can be referred to the silencing structures 116 in the first embodiment. Alternatively, it is also possible to arrange two opposite and aligned silencing structures 316 on the same radius direction of the bottom portion 314. As shown in FIG. 7, the silencing structures 316*a* and 316*b* are separated by a distance and disposed opposite to each other. Preferably, the silencing structures 316*a* and 316*b* are arranged in parallel. The shape of the silencing structure 316 can be a long strip, square, circle or any other geometrical shape. Preferably, the silencing structure 316 of this embodiment is a long strip recess, which is named as a blind-hole groove silencing structure.

When the fan assembly composed of the fan frame 31 and the impeller operates, the turbulence flow at the air outlet end O becomes more obvious so as to generate undesired noise. Similarly, the fan frame 31 of this embodiment has the silencing structure 316 (recess) configured at the bottom portion 314. This design can induce a vortex at the silencing structure 316 as the air flows through the bottom portion 314 (the air outlet end O). In other words, the vortex generated at the silencing structure 316 can minimize the turbulence flow at the air outlet end O, thereby reducing the noise caused by the turbulence flow.

In this embodiment, two silencing structures 316 are disposed at one radius direction and separated by a distance, and the silencing structures 316 are recesses. Therefore, the air flow around the air outlet end O caused by back pressure can form a vortex at the silencing structure 316*a* and then form another vortex at the silencing structure 316*b*. That is, the direction of the air flow is from the silencing structure 316*a* to the silencing structure 316*b*, thereby forming a directional return flow. This return flow can properly absorb the turbulence flow at the air outlet end O so as to reduce the noise caused by the turbulence flow. In addition, the distance between the silencing structures 316*a* and 316*b* can control the size of the return flow.

Figure 8A:
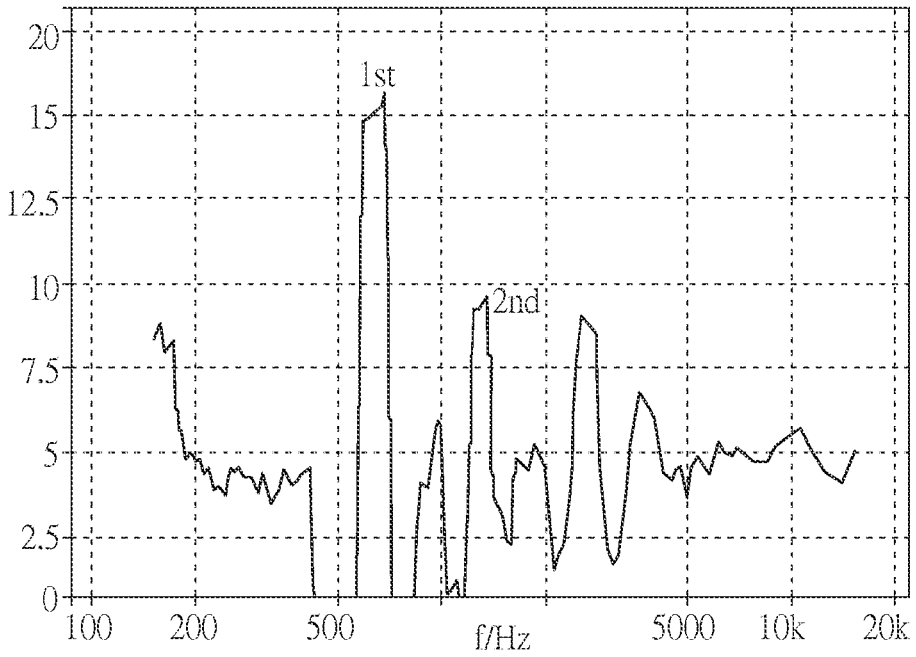
FIGS. 8A and 8B are spectrum diagrams of the operation sound of a conventional fan assembly.
Figure 8B:
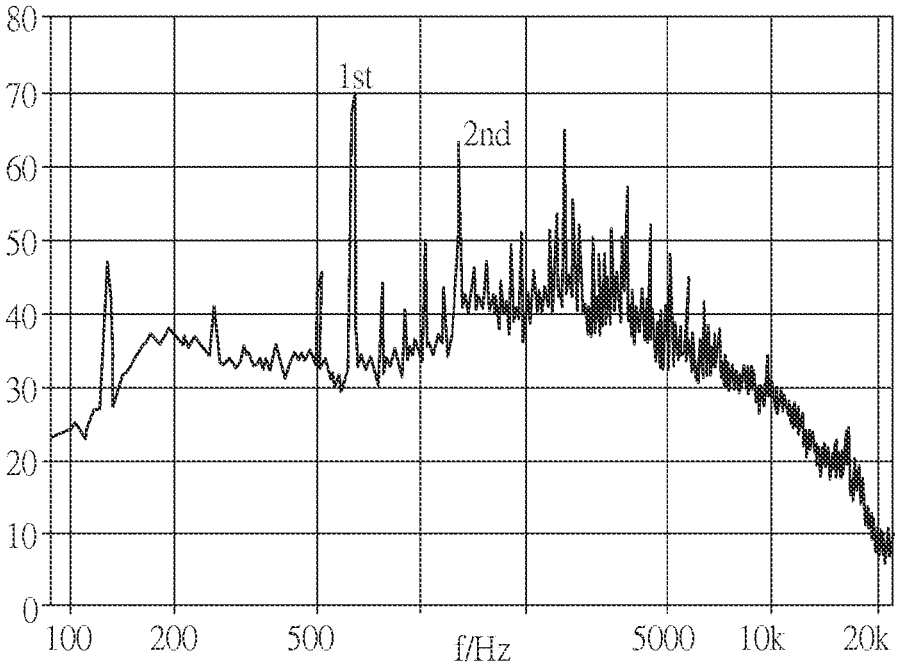
Figure 8C:
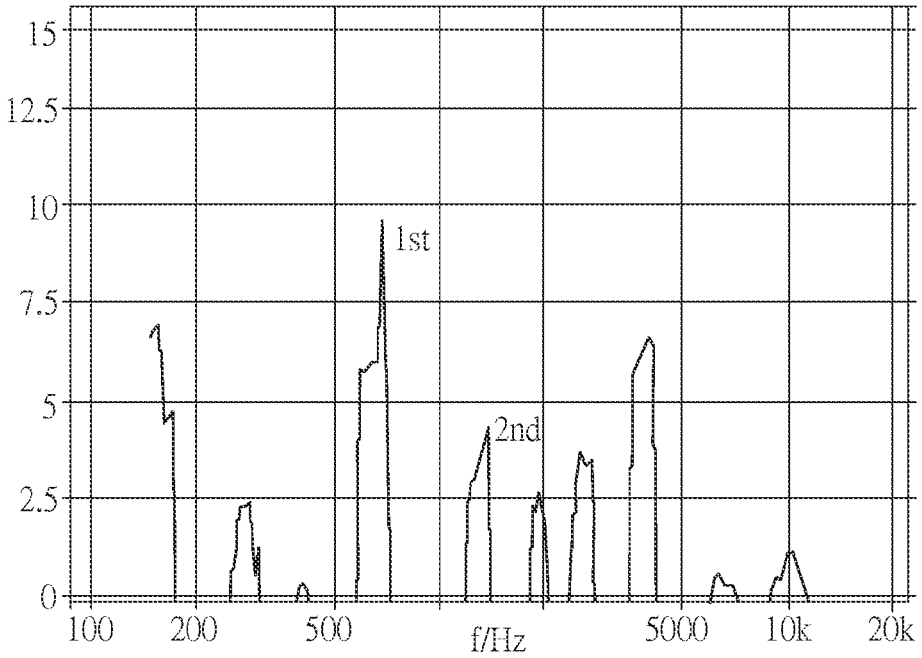
FIGS. 8C and 8D are spectrum diagrams of the operation sound of the fan assembly according to the first embodiment of the invention.
Figure 8D:
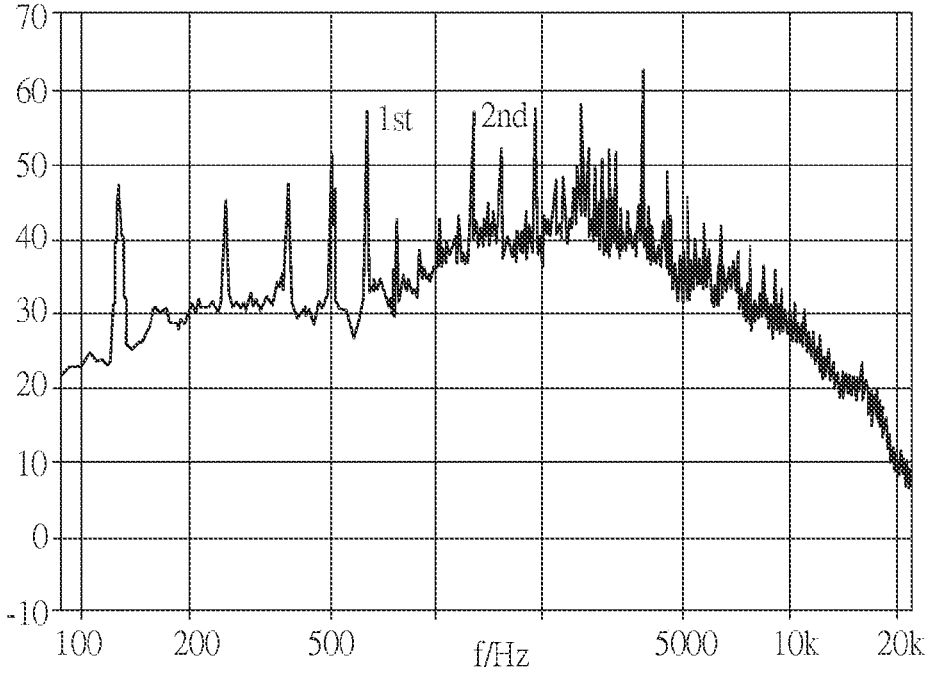

FIGS. 8A and 8B are spectrum diagrams of the operation sound of a conventional fan assembly, wherein the conventional fan assembly includes a fan frame with an enclosed space and an impeller with five blades. FIGS. 8C and 8D are spectrum diagrams of the operation sound of the fan assembly 1 according to the first embodiment of the invention, wherein the bottom portion 114 of the fan assembly 1 includes a plurality of symmetric silencing structures 116, and the impeller 12 has five blades. The conventional fan assembly (see FIGS. 8A and 8B) and the fan assembly 1 (see FIGS. 8C and 8D) are all operated and tested in the rotation speed of 7700 rpm. Herein, the first natural frequency is 643 Hz (labeled as 1st in the figures), and the second natural frequency is 1288 Hz (labeled as 2nd in the figures). Comparing FIGS. 8A and 8C and comparing FIGS. 8B and 8D, it is found that the first and second natural frequencies of the fan assembly 1 (see FIGS. 8C and 8D) are lower than that of the conventional fan assembly (see FIGS. 8A and 8B) by 5 dB. As a result, the fan frame of the embodiment having the silencing structures located at the bottom portion can effectively decrease the noise.

Figure 9A:
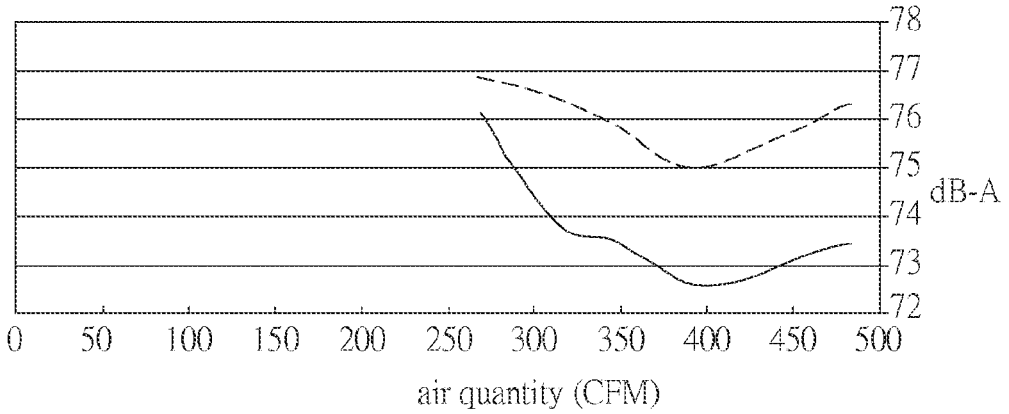
FIG. 9A is a schematic diagram showing the measured noises of the conventional fan assembly and the fan assembly according to the first embodiment of the invention.
Figure 9B:
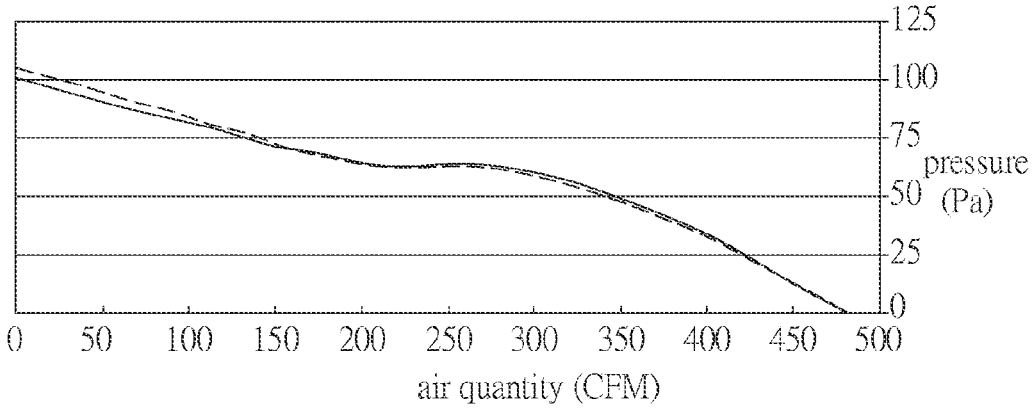
FIG. 9B is a schematic diagram showing the static pressure-air quantity properties of the conventional fan assembly and the fan assembly according to the first embodiment of the invention.

FIG. 9A is a schematic diagram showing the measured noises of the conventional fan assembly and the fan assembly according to the first embodiment of the invention, and FIG. 9B is a schematic diagram showing the static pressure-air quantity properties of the conventional fan assembly and the fan assembly 1 according to the first embodiment of the invention. In the figures, the dotted lines show the results of the conventional fan assembly, and the solid lines show the results of the fan assembly 1. According to FIG. 9A, the fan assembly 1 of the embodiment generates the noise lower than the conventional fan assembly by 2.5 dB-A. According to FIG. 9B, it is found that the static pressure-air quantity properties of the conventional fan assembly and the fan assembly 1 of the embodiment are almost the same.

Figure 10A:
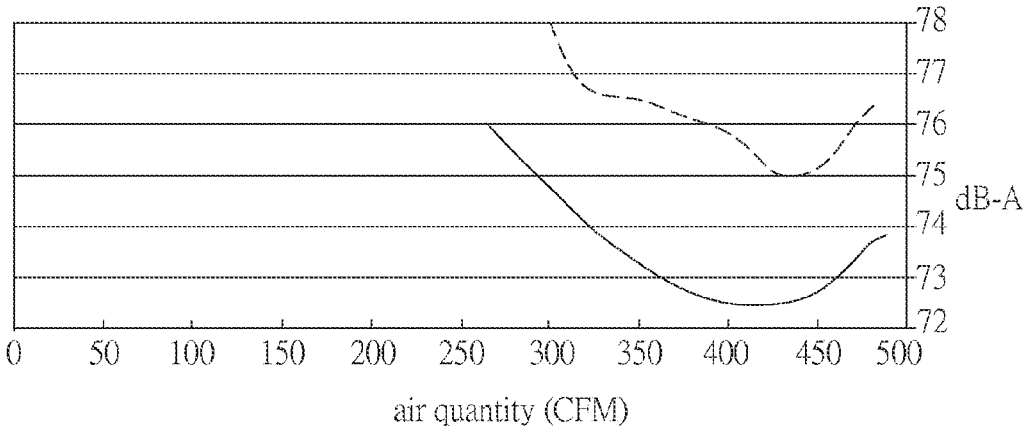
FIG. 10A is a schematic diagram showing the measured noises of the conventional fan assembly and the fan assembly according to the third embodiment of the invention.
Figure 10B:
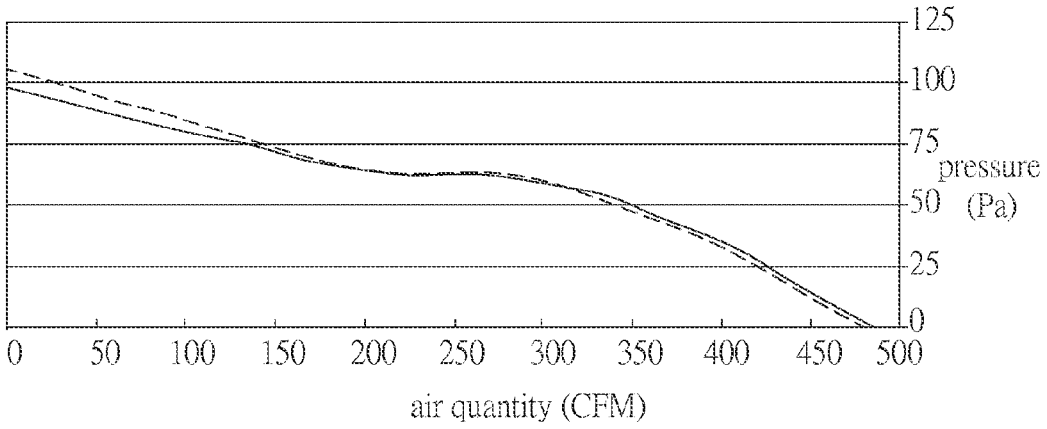
FIG. 10B is a schematic diagram showing the static pressure-air quantity properties of the conventional fan assembly and the fan assembly according to the third embodiment of the invention.

FIG. 10A is a schematic diagram showing the measured noises of the conventional fan assembly and the fan assembly according to the third embodiment of the invention, and FIG. 10B is a schematic diagram showing the static pressure-air quantity properties of the conventional fan assembly and the fan assembly according to the third embodiment of the invention. In the figures, the dotted lines show the results of the conventional fan assembly, and the solid lines show the results of the fan assembly 1. According to FIG. 10A, the fan assembly of the embodiment generates the noise lower than the conventional fan assembly by 2.5 dB-A. According to FIG. 10B, it is found that the static pressure-air quantity properties of the conventional fan assembly and the fan assembly 1 of the embodiment are almost the same. As a result, the fan frame of the embodiment can effectively reduce the noise, and the configuration of the silencing structure(s) does not affect the static pressure-air quantity property, which means the air quantity is remained.

In summary, the fan frame of the invention is configured with a silencing structure, and the silencing structure is positioned at the bottom portion (the air outlet end) while the bottom portion has a non-planar shape. When the airflow generated by the fan flows through the bottom portion, it is possible to generate a small vortex at the bottom portion due to the design of the silencing structure, thereby reducing the turbulence flow at the air outlet end. As a result, the noise caused by the turbulence flow can be sufficiently decreased. More important, the configuration of the silencing structure can achieve the purpose of decreasing noise without affecting the original static pressure-air quantity property of the fan assembly.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A fan frame having an air inlet end and an air outlet end, the fan frame comprising:

a sidewall;

a top portion connected to one end of the sidewall and disposed close to the air inlet end; and a bottom portion connected to the other end of the sidewall and disposed close to the air outlet end, wherein the bottom portion has at least a silencing structure, wherein the sidewall forms an outer frame of the fan frame, a chamber along a radial direction of the fan frame is embedded inside the sidewall, an inner width of the chamber along the radial direction is greater than a width of an inlet of the chamber along the radial direction, the silencing structure is the inlet of the chamber, and the chamber does not communicate with the air inlet end.

2. The fan frame of claim 1, wherein the bottom portion has two of the silencing structures, and the two silencing structures are separated by a distance and aligned to each other.

3. The fan frame of claim 1, wherein the bottom portion has a plurality of the silencing structures, and the silencing structures are arranged discontinuously and symmetrically.

4. The fan frame of claim 1, wherein the shape of the silencing structure is a long strip, square, circle or any other geometric shape.

5. The fan frame of claim 1, wherein the sidewall comprises an inner sidewall and an outer sidewall disposed opposite to the inner sidewall, the top portion connects the inner sidewall to the outer sidewall, the bottom portion connects the inner sidewall to the outer sidewall, and the inner sidewall, the outer sidewall, the top portion and the bottom portion form the chamber.

6. The fan frame of claim 5, wherein the silencing structure is a through hole connecting the chamber to outside.

7. The fan frame of claim 5, further comprising a first frame member and a second frame member, wherein the inner sidewall, the top portion and a part of the outer sidewall form the first frame member, and the bottom portion and a part of the outer sidewall form the second frame member.

8. The fan frame of claim 5, wherein the top portion has at least a drainage hole.

9. The fan frame of claim 6, wherein the silencing structure forms a non-planar shape on the bottom portion.

10. A fan assembly, comprising:

a fan frame having an air inlet end and an air outlet end, wherein the fan frame comprises:

a sidewall, a top portion connected to one end of the sidewall and disposed close to the air inlet end, and a bottom portion connected to the other end of the sidewall and disposed close to the air outlet end, wherein the bottom portion has at least a silencing structure; and an impeller disposed on the fan frame, wherein the sidewall forms an outer frame of the fan frame, a chamber along a radial direction of the fan frame is embedded inside the sidewall, an inner width of the chamber along the radial direction is greater than a width of an inlet of the chamber along the radial direction, the silencing structure is the inlet of the chamber, and the chamber does not communicate with the air inlet end.

11. The fan assembly of claim 10, wherein the bottom portion has two of the silencing structures, and the two silencing structures are separated by a distance and aligned to each other.

12. The fan frame of claim 10, wherein the bottom portion has a plurality of the silencing structures, and the silencing structures are arranged discontinuously and symmetrically.

13. The fan assembly of claim 10, wherein the shape of the silencing structure is a long strip, square, circle or any other geometric shape.

14. The fan assembly of claim 10, wherein the sidewall comprises an inner sidewall and an outer sidewall disposed opposite to the inner sidewall, the top portion connects the inner sidewall to the outer sidewall, the bottom portion connects the inner sidewall to the outer sidewall, and the inner sidewall, the outer sidewall, the top portion and the bottom portion form the chamber.

15. The fan assembly of claim 14, wherein the silencing structure is a through hole connecting the chamber to outside.

16. The fan assembly of claim 14, wherein the fan frame further comprises a first frame member and a second frame member, the inner sidewall, the top portion and a part of the outer sidewall form the first frame member, and the bottom portion and a part of the outer sidewall form the second frame member.

17. The fan assembly of claim 14, wherein the top portion has at least a drainage hole.

18. The fan frame of claim 15, wherein the silencing structure forms a non-planar shape on the bottom portion.

* * * * *